US006739911B2

(12) United States Patent
Wagatsuma et al.

(10) Patent No.: US 6,739,911 B2
(45) Date of Patent: May 25, 2004

(54) CARD CONNECTOR UNIT PROVIDED WITH FIRST ACCOMMODATING POSITION AND SECOND ACCOMMODATING POSITION

(75) Inventors: Toru Wagatsuma, Miyagi-ken (JP); Yoshimasa Kuroda, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 94 days.

(21) Appl. No.: 10/081,946

(22) Filed: Feb. 20, 2002

(65) Prior Publication Data

US 2002/0137375 A1 Sep. 26, 2002

(30) Foreign Application Priority Data

Mar. 26, 2001 (JP) ..... 2001-088265

(51) Int. Cl.[7] ..... H01R 13/648
(52) U.S. Cl. ..... 439/609
(58) Field of Search ..... 439/131, 159, 439/160, 630, 372, 157, 609, 108, 64, 59, 101, 686; 361/684–686

(56) References Cited

U.S. PATENT DOCUMENTS 5,478,260 A * 12/1995 Kaufman et al. ..... 439/609
5,535,093 A * 7/1996 Noguchi et al. ..... 361/686
6,503,092 B1 * 1/2003 Sato ..... 439/159

FOREIGN PATENT DOCUMENTS

JP 2000-251025 9/2000

* cited by examiner

*Primary Examiner*—Jean F. Duverne
(74) *Attorney, Agent, or Firm*—Beyer Weaver & Thomas

(57) ABSTRACT

A first accommodating position and a second accommodating position differing in the extent of insertion of an SD card are set; and there are provided a first terminal section to be into contact with a group of external connection terminals of the SD card in the first accommodating position and a second terminal section to be in contact with the group of external connection terminals of the SD card in the second accommodating position. This makes it possible to place a shorter SD card in the first accommodating position and a longer SD card in the second accommodating position with the extent of outward protrusion of the card substantially reduced. If matching terminal pieces of the first and second terminal sections are electrically connected to each other by forming them as integrated units made of metal sheets or otherwise, the task of their fitting to an electronic apparatus per se can be simplified.

5 Claims, 23 Drawing Sheets

CARD CONNECTOR UNIT PROVIDED WITH FIRST ACCOMMODATING POSITION AND SECOND ACCOMMODATING POSITION

BACKGROUND OF THE INVENTION

1. Field of the Invention

The present invention relates to a card connector unit for accommodating a small memory card or what is known as an SD card and connecting a group of external connection terminals provided on this card to an electronic circuit provided in an electronic device, such as a personal computer (PC) and more particularly to a card connector unit compatible with two types of cards differing in length from each other.

2. Description of the Related Art

Cards that can be freely inserted or withdrawn from an electronic device such as a PC or an electronic camera and permits writing or reading of information (hereinafter referred to as SD cards) are already known according to the prior art. This kind of card is substantially rectangularly shaped, and at one end of one side are arrayed a plurality of external connection terminals. The electronic device to accommodate such SD cards is provided with a circuit board on which are mounted required electronic circuits and a card connector unit for connecting the group of external connection terminals mounted on the SD card to the electronic circuits.

Such a card connector unit is provided with a housing having an accommodating space into which the SD card is to be inserted through an inlet, a plurality of terminal pieces fixed to this housing and exposed in the accommodating space, and a discharging mechanism for discharging an accommodated SD card.

The housing is usually configured by combining a frame made of an insulating material and a cover made of a metallic material or an insulating material, and an SD card accommodating space is formed between the frame and the cover. Each terminal piece is provided with a contact exposed within the accommodating space to be able to come into contact with the connection terminals of an SD card and a soldering portion to be soldered onto an electronic circuit provided in an electronic apparatus such as a personal computer (PC). It is so designed that, when an SD card inserted into the accommodating space is placed in a prescribed position, the group of its external connection terminals come into contact with the contact of each terminal piece.

A discharging mechanism of a known configuration, for instance, comprises a slider capable of reciprocating in engagement with an SD card, coil springs elastically energizing this slider in the direction of discharging the card, and engaging pins guided along a heart-shaped cam groove. When the operator presses with fingers the SD card placed in a prescribed position, on the edge toward him or her (rear edge), this configuration, by causing the slider and the engaging pin to work in conjunction, enables the card to move together with the slider outward to the operator's side to be readily discharged. Another known configuration is such that, by operating a member for discharging action to release the SD card engaged in a prescribed position, the card can be discharged.

Incidentally, in connection with a recently rising call for the usability of an SD card not only as a mere recording medium but also as a communication device by providing it with a transmitter/receiver circuit or the like, the emergence of a new type SD card extended in length but the same in terminal specification as the conventional SD card is expected.

However, since the conventional card connector unit does not have a structure to accommodate such a long SD card, if the SD card is inserted for intended electrical connection, the SD card will substantially protrude outward from the inlet of the accommodating space of the housing, but it will be impossible to insert the SD card more deeply. Thus, if it is tried to adapt a conventional card connector unit to a longer than usual SD card, not only will the appearance of the unit holding such an SD card be awkward but also it will result in serious inconvenience for use because the electronic apparatus such as a laptop PC will have to be carried with the SD card kept inserted in the connector unit.

SUMMARY OF THE INVENTION

The present invention has been attempted to obviate these disadvantages of the prior art, and to provide a more convenient card connector unit allowing ready placement of either of two types of SD card differing in length from each other.

In order to achieve the object stated above, a card connector unit according to the invention comprises a housing having an accommodating space into which a card (SD card) provided with a group of external connection terminals is inserted from a side of an inlet, and a first terminal section and a second terminal section fixed to the housing and arranged in the accommodating space with positional discrepancy between them in a depthwise direction, wherein a first accommodating position and a second accommodating position differing in an extent of insertion of the card into the accommodating space are set, wherein the group of external connection terminals are in contact with the first terminal section when the card is placed in the first accommodating position, and wherein the group of external connection terminals are in contact with the second terminal section when the card is placed in the second accommodating position.

A connector unit of such a configuration, if, for instance, the second accommodating position is set farther inward than the first accommodating position, can not only use a shorter SD card placed in the first accommodating position but also a longer card placed in the second accommodating position. Thus, for the longer SD card, there is available an accommodating position in which the card can be inserted deeply to be used, so that the SD card, when in place, does not significantly protrude outward, and accordingly there is no fear of ruining the external appearance or the portability of the connector unit.

If, in the above-described configuration, the first terminal section and the second terminal section have an equal number of terminal pieces arranged along a widthwise direction of the card inserted into the accommodating space, and the respectively matching terminal pieces of these first and second terminal sections are electrically connected to each other, it will suffice to connect terminal pieces on only one side to an external circuit (an electronic circuit provided on the electronic apparatus per se), and the task of fitting the connector unit to the electronic apparatus per se can be simplified. In this case, if respectively matching terminal pieces of the first and second terminal sections comprise mutually connected, integrated units made of metal sheets, and part of these integrated units has soldering portions for soldering onto an external circuit, the first and second terminal sections can be easily formed by pressing, and their fixing to the housing can be easily accomplished by insert molding, resulting in facilitated manufacturing of connector units.

Further, if, in the above-described configuration, the first and second accommodating positions are set so that, for two types of the SD cards differing in length in an inserting/discharging direction, an extent of an external protrusion of a shorter one of the SD cards out of the inlet when placed in the first accommodating position is made substantially equal to an extent of an external protrusion of a longer one of the SD cards out of the inlet when placed in the second accommodating position, the two states will look similar and accordingly neater in external appearance, resulting also in enhanced convenience for use.

Further, if, in the above-described configuration, there are provided a first discharging mechanism for shifting the card placed in the first accommodating position in the discharging direction and a second discharging mechanism for shifting the card placed in the second accommodating position in the discharging direction, each of the first and second discharging mechanisms being provided with a sliding member capable of reciprocating in the depthwise direction, an engaging pin shifting along a heart-shaped cam groove along with shifting of the sliding member, and an energizing member for elastically energizing the sliding member in the discharging direction of the card; wherein, when the card is placed in the first accommodating position or the second accommodating position, the engaging pin of the matching one of the discharging mechanisms is engaged with a pin engaging portion of the heart-shaped cam groove to inhibit shifting of the sliding member, and wherein by pressing the card deeper in the accommodating space in such a state and thereby disengaging the engaging pin from the pin engaging portion, the card is shifted in the discharging direction along with shifting of the sliding member, then the operator can discharge the SD card merely pressing the card, placed in either the first accommodating position or the second accommodating position. Therefore, the operating ease is enhanced when the card is to be discharged, and there will be no need to provide a special operating member for discharging use.

DESCRIPTION OF THE PREFERRED EMBODIMENT

Figure 1:
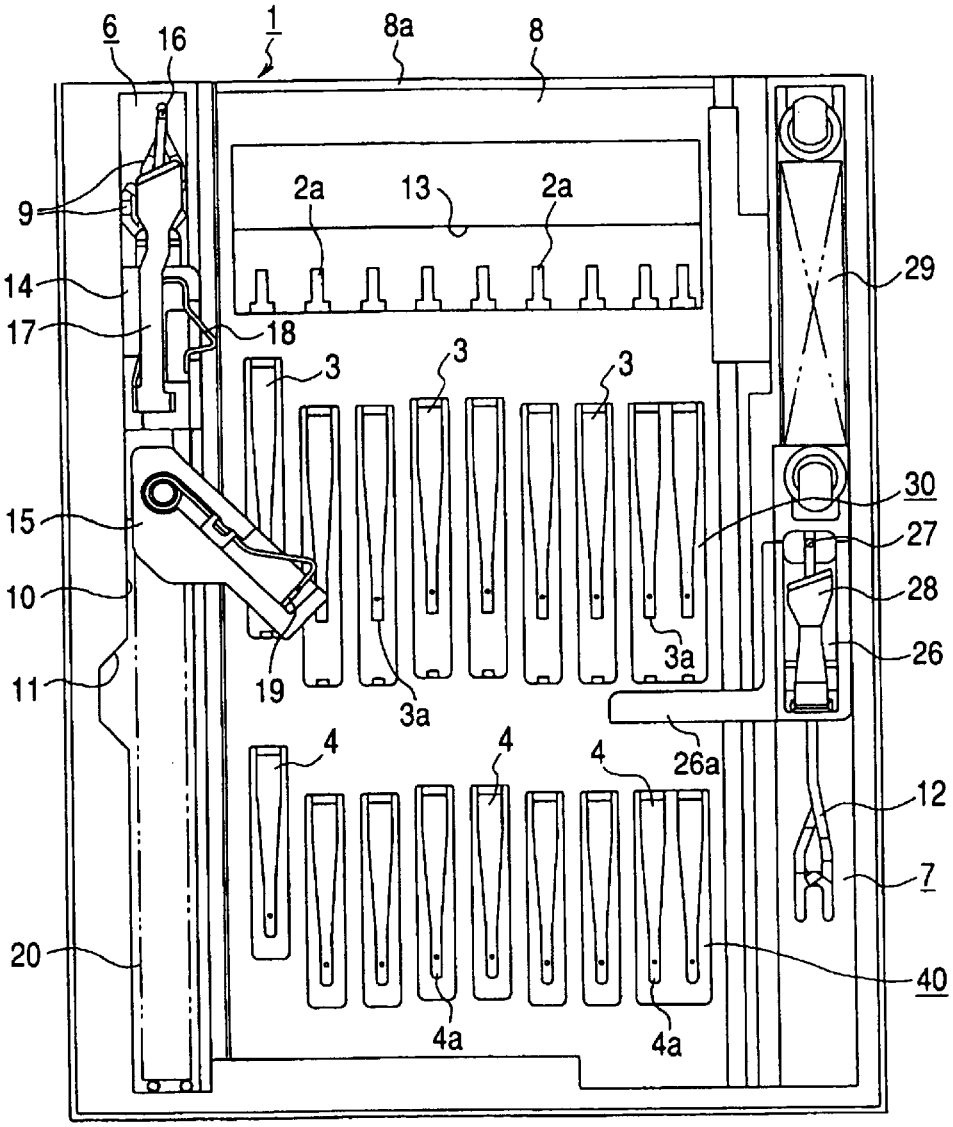
FIG. 1 shows a plan of a card connector unit in one mode of carrying out the present invention.
Figure 2:
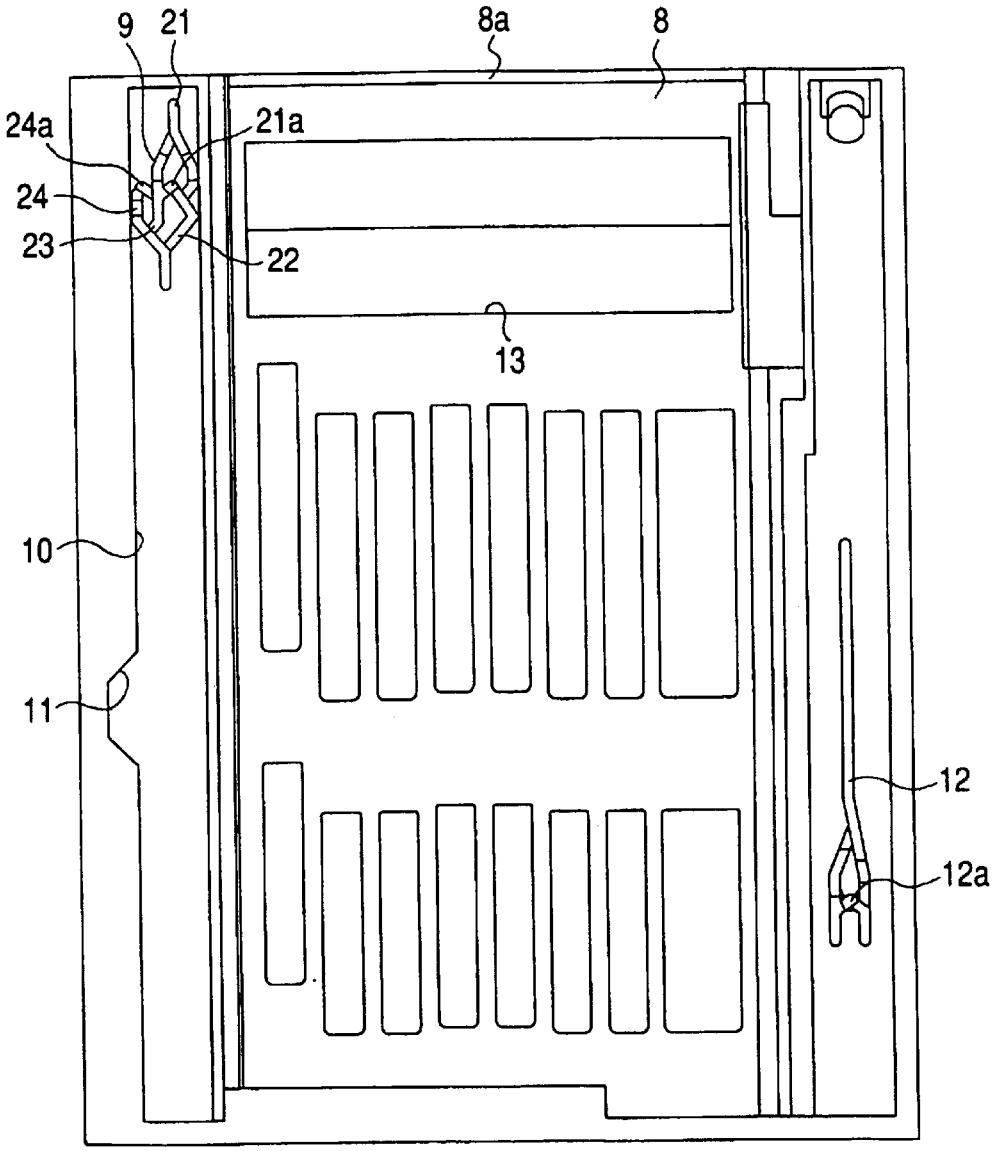
FIG. 2 shows a plan of the housing of the card connector unit.
Figure 3:
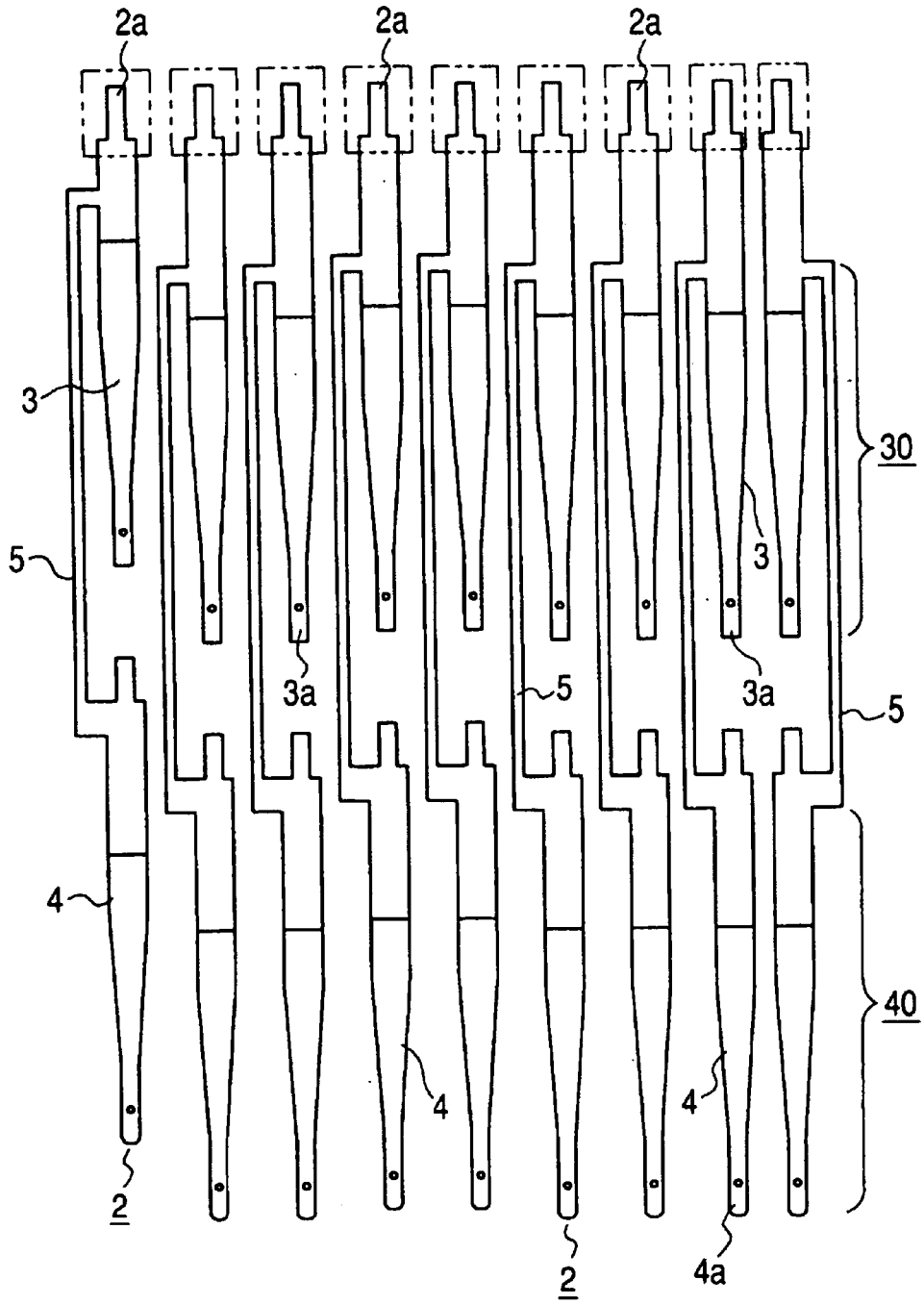
FIG. 3 shows a plan of the terminal section of the card connector unit.
Figure 4:
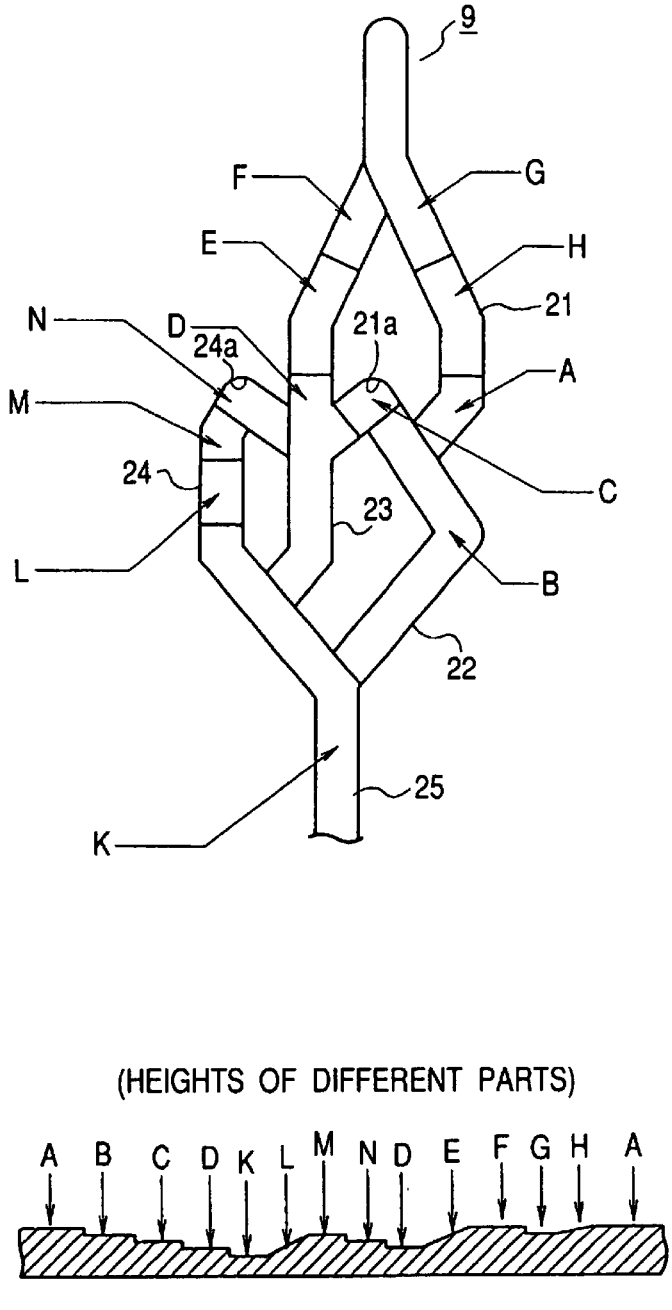
FIG. 4 illustrates a guide groove provided in a first discharging mechanism of the card connector unit.
Figure 5:
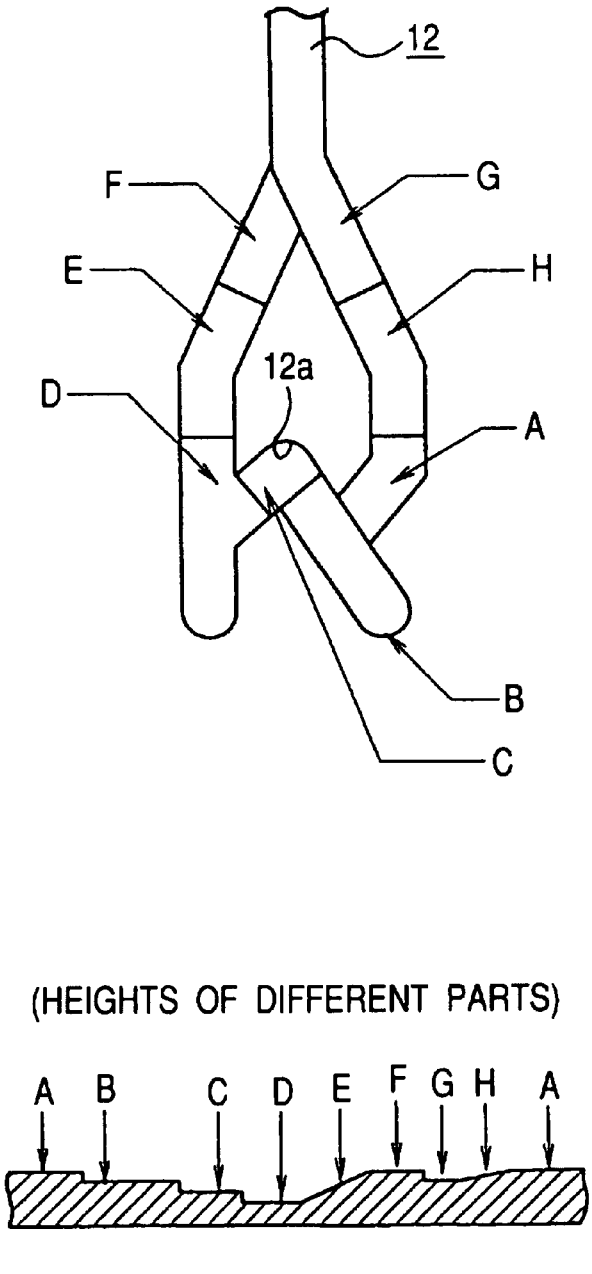
FIG. 5 illustrates a guide groove provided in a second discharging mechanism of the card connector unit.

To describe a mode of carrying out the present invention with reference to accompanying drawings, FIG. 1 shows a plan of a card connector unit in the mode of carrying out the invention with the illustration of its cover dispensed with; FIG. 2 shows a plan of the housing of the card connector unit; FIG. 3, a plan of the terminal section of the card connector unit; FIG. 4 illustrates a guide groove provided in a first discharging mechanism of the card connector unit; and FIG. 5, a guide groove provided in a second discharging mechanism of the card connector unit.

The card connector unit illustrated in these drawings is intended for accommodating an SD card into the electronic device such as a PC which it is built into. A group of external connection terminals of an SD card placed in a prescribed position can be connected to an electronic circuit provided in an electronic apparatus per se. This card connector unit is configured to accommodate not only a shorter SD card but also a longer SD card.

To describe the specific configuration, this card connector unit mainly consists of a housing composed by combining a frame 1 made of an insulating material and a cover (not shown) made of a metallic material, a plurality of metal sheet-made terminal units 2 constituted by linking terminal pieces 3 and 4 by a linking portion 5 and fixed to the frame 1 by an insert formation technique, a first discharging mechanism 6 provided on one side of the frame 1 and a second discharging mechanism 7 provided on the other side of the frame 1.

Between the frame 1 and the cover of the housing, there is formed an accommodating space 8 into which an SD card is to be inserted from the inlet 8*a* side. Also, as shown in FIG. 2, on one side of the frame 1 are formed guide grooves 9 constituting a part of the first discharging mechanism 6, a regulating wall 10 and a cutout 11, and on the other side of the frame 1 is formed a heart-shaped cam groove 12 constituting a part of the second discharging mechanism 7. Further, in the frame 1 is formed, near the inlet 8*a*, a peephole 13 through which ends of the terminal units 2 on one side are exposed.

The terminal units 2 are arranged in two rows, fore and rear, as shown in FIGS. 1 and 3. A group of terminal pieces 3 exposed near the central part of the accommodating space 8 constitute a first terminal section 30, and a group of terminal pieces 4 exposed in a deep part of the accommodating space 8 constitute a second terminal section 40. Each pair of terminal pieces 3 and 4 of these first and second terminal sections 30 and 40 are arranged on the same straight line in the depthwise (lengthwise) direction of the frame 1, and linked by the linking portion 5 as described above. Further, the free ends of the terminal pieces 3 and 4 constitute contacts 3*a* and 4*a*, respectively, and the relative positional relationship among the contacts 3*a* and that among the contacts 4*a* are all set to be equivalent to the relative positional relationship (terminal arrangement) among the grouped external connection terminals of the SD card. At the ends on one side of the terminal units 2 including the paired terminal pieces 3 and 4, there are provided soldering portions 2*a* as shown in FIG. 3, and the soldering portion 2*a* of each terminal unit 2 protrudes into the peephole 13 of the frame 1. These soldering portions 2*a* are soldered onto an electronic circuit provided on a circuit board (not shown) of the electronic apparatus per se.

Thus, in this card connector unit are set a first accommodating position in which an SD card with a smaller insertion depth is to be placed and a second accommodating position in which an SD card with a greater insertion depth is to be placed. If the SD card is inserted to the vicinity of the central part of the accommodating space 8 and placed in the first accommodating position, its group of external connection terminals will come into contact with the contacts 3*a* of the terminal piece 3. Or if the SD card is inserted as far as to a deep part of the accommodating space 8 and placed in the second accommodating position, its group of external connection terminals will come into contact with the contacts 4*a* of the terminal piece 4.

The first discharging mechanism 6 is provided with a first sliding member 14 capable of reciprocating along the inserting/discharging direction of the SD card, an engaging arm 15 rotatably borne by this sliding member 14 and capable of engaging with the fore edge of the SD card, a first engaging pin 16 moving along the guide groove 9 together with the shifting of the first sliding member 14, a keep plate 17 for keeping this engaging pin 16 from running off the groove 9, a first elastic piece 18 capable of engaging with a recess provided on one side edge of the SD card and held by the first sliding member 14, a second elastic piece 19 capable of engaging with the recess of the SD card and held by the engaging arm 15, and a first coil spring 20 for elastically energizing the first sliding member 14 in the discharging direction of the card. The regulating wall 10 and the cutout 11 of the frame 1 also are constituent elements of the first discharging mechanism 6. The regulating wall 10 regulates the outward rotation of the engaging arm 15 when the inserted position of the SD card has not yet reached the first accommodating position. On the other hand, the cutout 11, on the way of the SD card shifting from the first accommodating position toward the second accommodating position, permits the engaging arm 15 to rotate outward and sets aside the engaging arm 15.

The guide groove 9 is provided with a heart-shaped cam groove 21 having a pin engaging portion 21*a* for engaging the first engaging pin 16 to keep the SD card in the first accommodating position, a first guide groove 22 continuous from the heart-shaped cam groove 21 upstream from the pin engaging portion 21*a* and extending inward, a second guide groove 23 continuous to and from the heart-shaped cam groove 21 downstream from the pin engaging portion 21*a* and extending inward, a return path 24 for guiding the progress of the first engaging pin 16 in the process of the shifting of the SD card from the second accommodating position to the first accommodating position, and an extended path 25 continuous from the two guide grooves 21 and 22 and the return path 24 and extending inward. Within the return path 24 is formed a return pin engaging portion 24*a* for engaging the first engaging pin 16 on the way of shifting along this return path 24 and thereby to hold the SD card in the first accommodating position This return path 24 is made continuous to and from the second guide groove 23 downstream from the return pin engaging portion 24*a*. When the first engaging pin 16 is engaged by either the pin engaging portion 21*a* or the return pin engaging portion 24*a*, as the shifting of the first sliding member 14 is thereby inhibited, the SD card engaged with the first sliding member 14 via the first elastic piece 18 is held in the first accommodating position.

The second discharging mechanism 7 is provided with a second sliding member 26 having an engaging portion 26*a* projecting from it and capable of being engaged with the fore edge of the SD card, the sliding member 26 being capable of shifting reciprocatively along the inserting/discharging direction of the SD card, a second engaging pin 27 shifting along the heart-shaped cam groove 12 together with the shifting of this sliding member 26, a keep plate 28 for keeping this engaging pin 27 from running off the heart-shaped cam groove 12, and a second coil spring 29 for elastically energizing the second sliding member 26 in the discharging direction of the SD card. In the heart-shaped cam groove 12 is formed a pin engaging portion 12*a*. When the SD card is in the second accommodating position, the second engaging pin 27 is engaged by the pin engaging portion 12*a* to obstruct the second sliding member 26 from shifting. At this time, the second elastic piece 19 held by the engaging arm 15 engaged with the recess of the SD card to hold the SD card in the second accommodating position.

Next will be described with reference to FIG. 6 through FIG. 17 the operation of the card connector unit configured as described above. First will be described its actions when a longer SD card 60 than the currently more common shorter SD card 50 is to be used with reference to FIG. 6 through FIG. 15.

Toward the fore edge of the longer SD card 60 in the inserting direction, there are provided a group of external connection terminals 61 that can come into contact with the contacts 3*a* and 4*a* of the terminal pieces 3 and 4, respectively. On one side edge of this SD card 60 is provided a recess 62 that can engage with the elastic pieces 18 and 19 of the first discharging mechanism 6. This longer SD card 60 is designed to be equal to the shorter SD card 50 in all respects including the width, the arrangement of the group of external connection terminals 61 and the distance from the fore edge to the recess 62 except that the longer SD card 60 has at its rear end an antenna circuit (not shown). It is desirable, when this antenna circuit is to be used, to place the card in the connector unit in a state in which the rear edge of the card is exposed outside the inlet.

Figure 6:
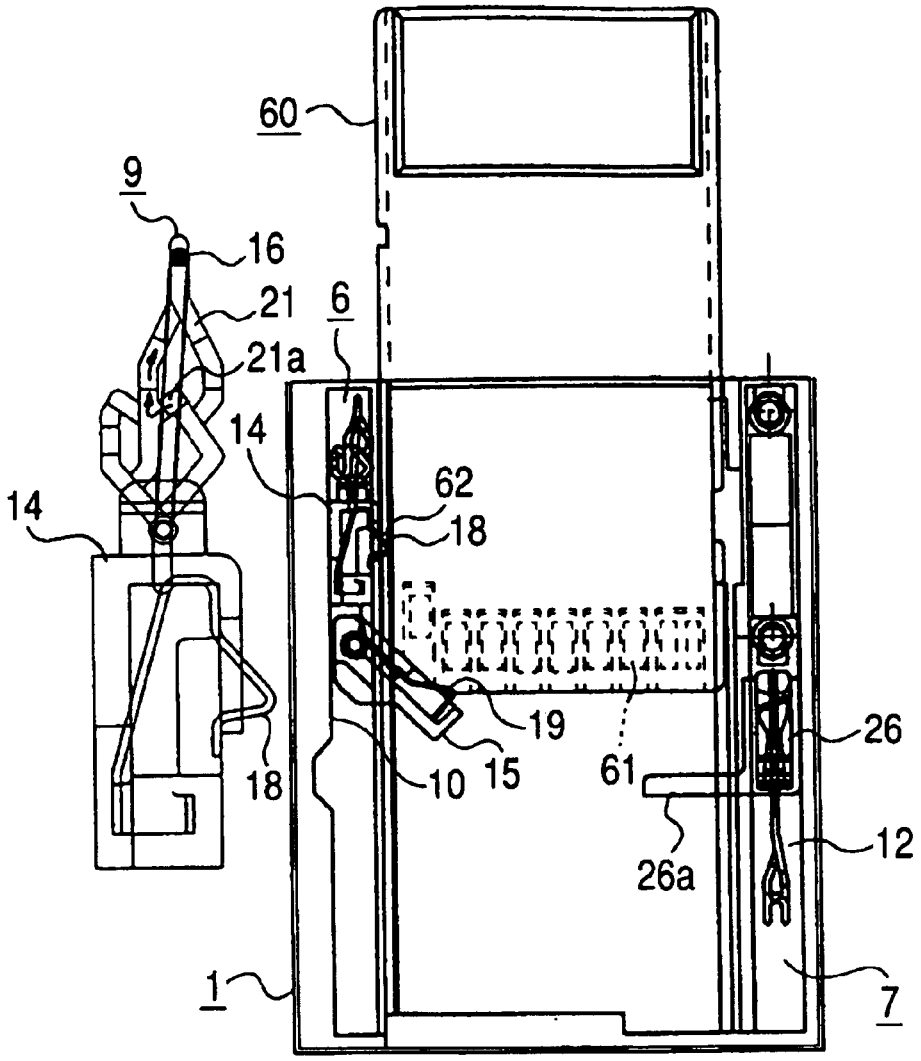
FIG. 6 illustrates the operation of the connector unit in which a longer SD card is inserted.

FIG. 6 shows a plan of the connector unit in this mode of carrying out the invention in a state immediately after the insertion of the longer SD card 60 is started. When the longer SD card 60 is inserted to the position shown in FIG. 6, the first elastic piece 18 engages with its recess 62, and the engaging arm 15 comes into contact with the fore edge of the SD card 60. Therefore, as the operator inserts the SD card 60 deeper, the engaging arm 15 whose outward rotation is regulated by the regulating wall 10 of the frame 1 is pressed inward by the SD card 60, the first sliding member 14 and the engaging arm 15 are shifted inward by the movement of the SD card 60 and, along with the shifting of the first sliding member 14, the first engaging pin 16 shifts along the heart-shaped cam groove 21.

Figure 7:
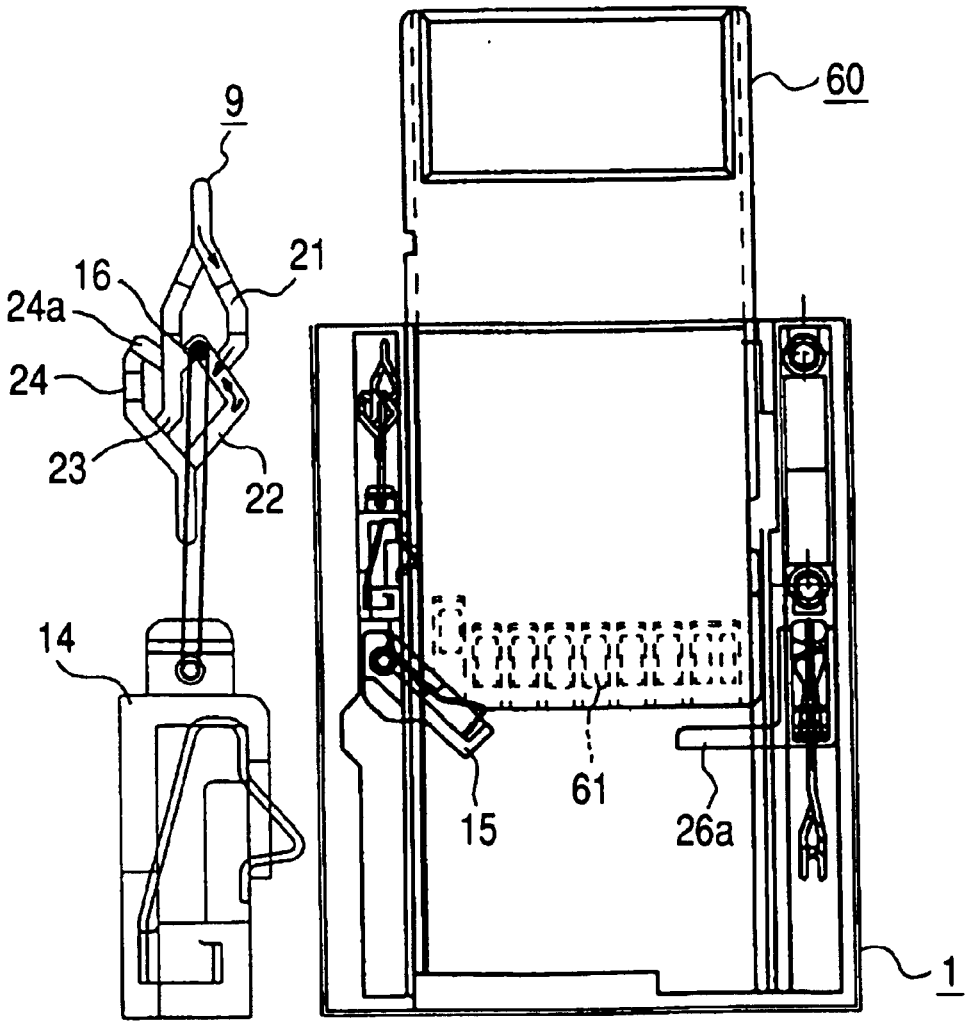
FIG. 7 illustrates the operation of the connector unit in which the longer SD card is inserted.
Figure 8:
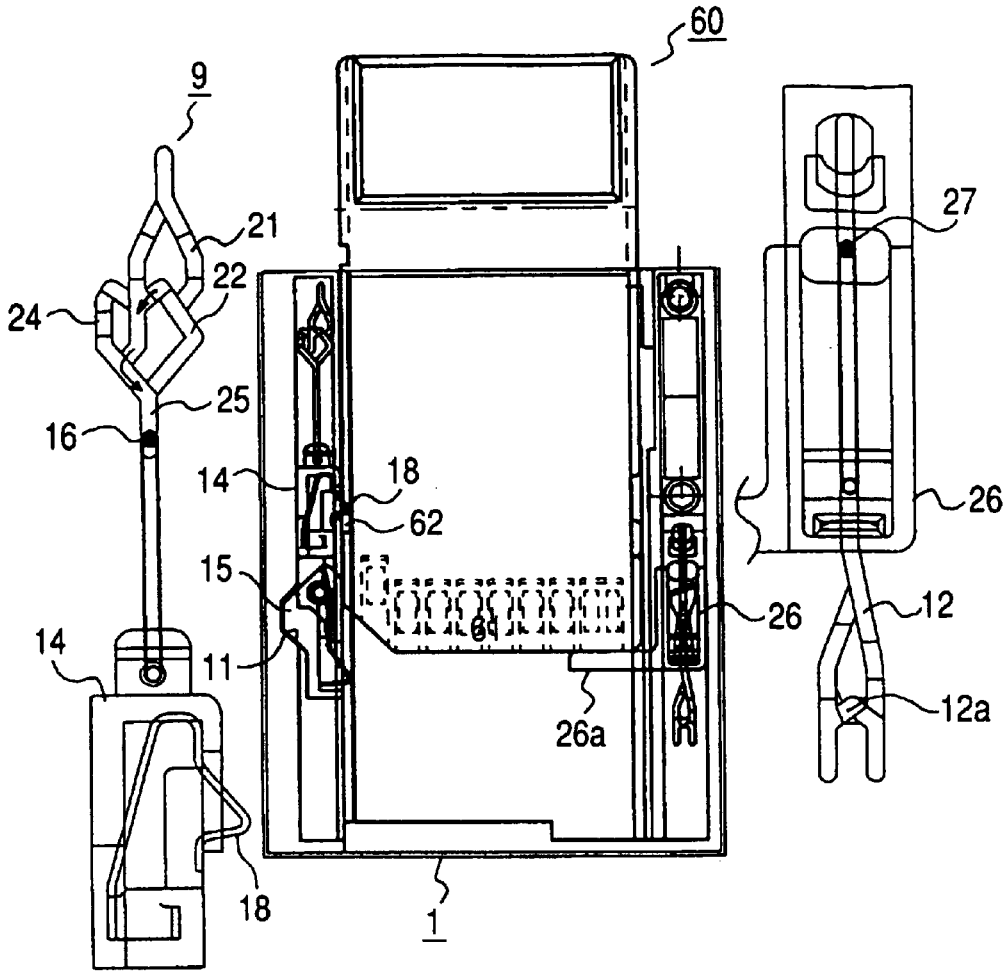
FIG. 8 illustrates the operation of the connector unit in which the longer SD card is inserted.

When the SD card 60 is pressed in somewhat deeper than the first accommodating position, the first engaging pin 16 shifts from the heart-shaped cam groove 21 to the first guide groove 22 as indicated by arrows in FIG. 7. Therefore, when the pressing force is removed, the elasticity of the first coil spring 20 presses outward the first sliding member 14 and the engaging arm 15 to enable the first engaging pin 16 to be engaged with the pin engaging portion 21*a*. Accordingly, the SD card 60 is held in the first accommodating position, in which the group of external connection terminals 61 are in contact with the contacts 3*a* of the terminal pieces 3, so that the antenna circuit exposed toward the operator is placed in a usable state.

When the SD card 60 thereby placed in the first accommodating position is to be discharged, the SD card 60 in the state shown in FIG. 7 can be pressed slightly inward. As this causes the first engaging pin 16 to be disengaged from the pin engaging portion 21*a* to shift downstream in the heart-shaped cam groove 21 as indicated by arrows in FIG. 6, the SD card 60 is pressed back to its discharging position by the first sliding member 14 and the engaging arm 15 which are shifted outward by the elasticity of the first coil spring 20. Thus, the operator can discharge the SD card 60 held in the first accommodating position by a simple one-push action.

Or when the SD card 60 held in the first accommodating position to use the antenna circuit is to be shifted to the second accommodating position, the operator can press inward the SD card 60 in the state of FIG. 7. Then, along with the shifting of the first sliding member 14, the first engaging pin 16 shifts from the heart-shaped cam groove 21 to the extended path 25 via the second guide groove 23 as indicated by arrows in FIG. 8. At the time when the SD card 60 has been inserted to the position shown in FIG. 8, the engaging arm 15, being pressed by the SD card 60, rotates outward to step aside into the cutout 11 of the frame 1, and accordingly the inward shifting of the engaging arm 15 is regulated. For this reason, even though the SD card 60 is pressed further inward, the first sliding member 14 remains unmoved, and the first elastic piece 18 is disengaged from the recess 62 of the SD card 60. However, as the fore edge of the SD card 60 is pressing inward the engaging portion 26*a* of the second sliding member 26 at this point of time, the second sliding member 26 follows the further inward shifting of the SD card 60, and the second engaging pin 27 shifts along the heart-shaped cam groove 12.

Figure 9:
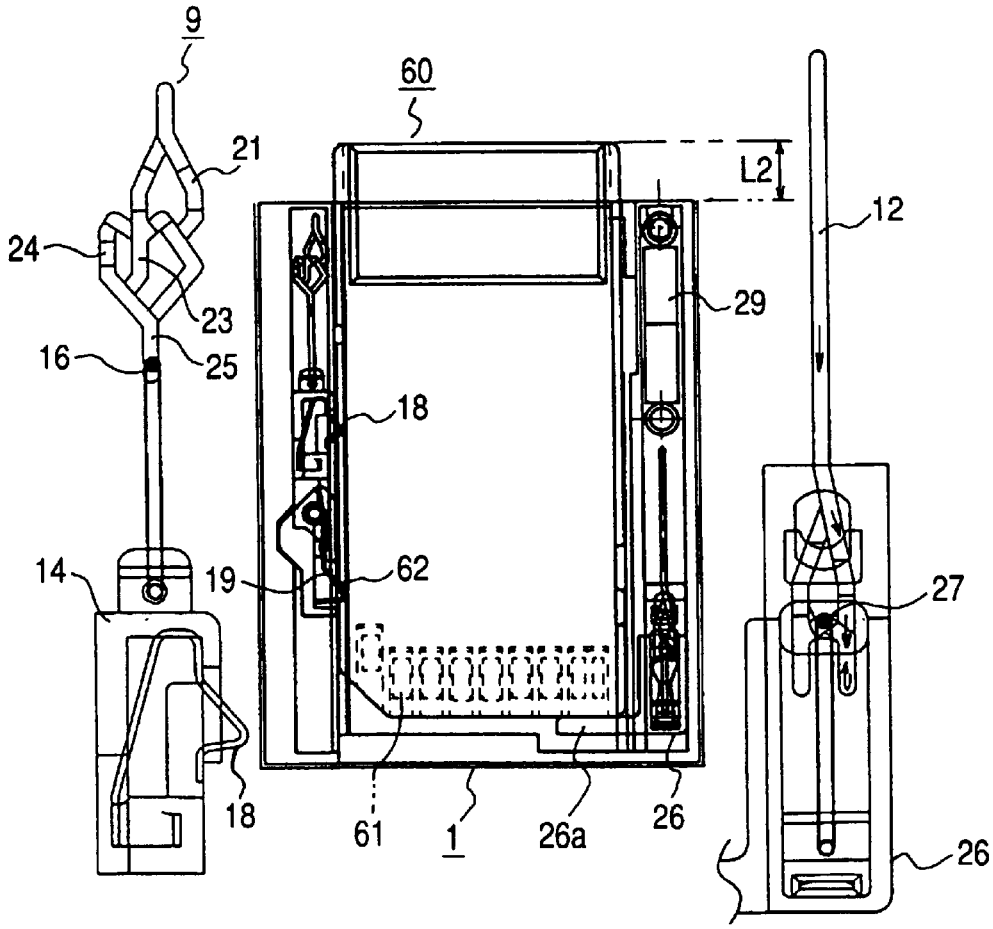
FIG. 9 illustrates the operation of the connector unit in which the longer SD card is inserted.
Figure 10:
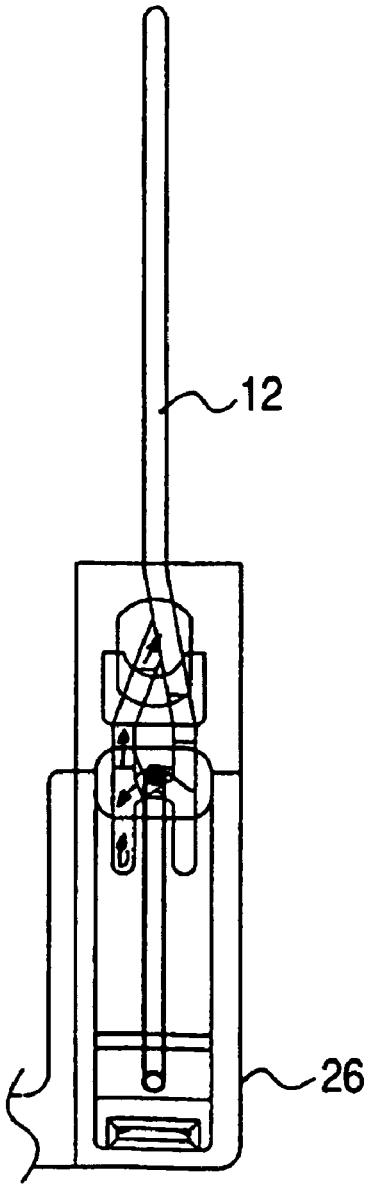
FIG. 10 illustrates the operation of the connector unit in which the longer SD card is inserted.

Then, by pressing the SD card 60 farther inward than the second accommodating position, the second engaging pin 27 is shifted in the heart-shaped cam groove 12 as indicated by arrows in FIG. 9. Therefore, when the pressing force is removed, the elasticity of the second coil spring 29 presses outward the second sliding member 26 to enable the second engaging pin 27 to be engaged with the pin engaging portion 12*a*. Accordingly, the SD card 60 is held in the second accommodating position in which the group of external connection terminals 61 are in contact with the contacts 4*a* of the terminal pieces 4, and is kept in a stowed state in which it does not protrude substantially outward. Incidentally, when the SD card 60 is placed in the second accommodating position, the second elastic piece 19 is in the recess 62 in the SD card 60 to be engaged with it.

Figure 11:
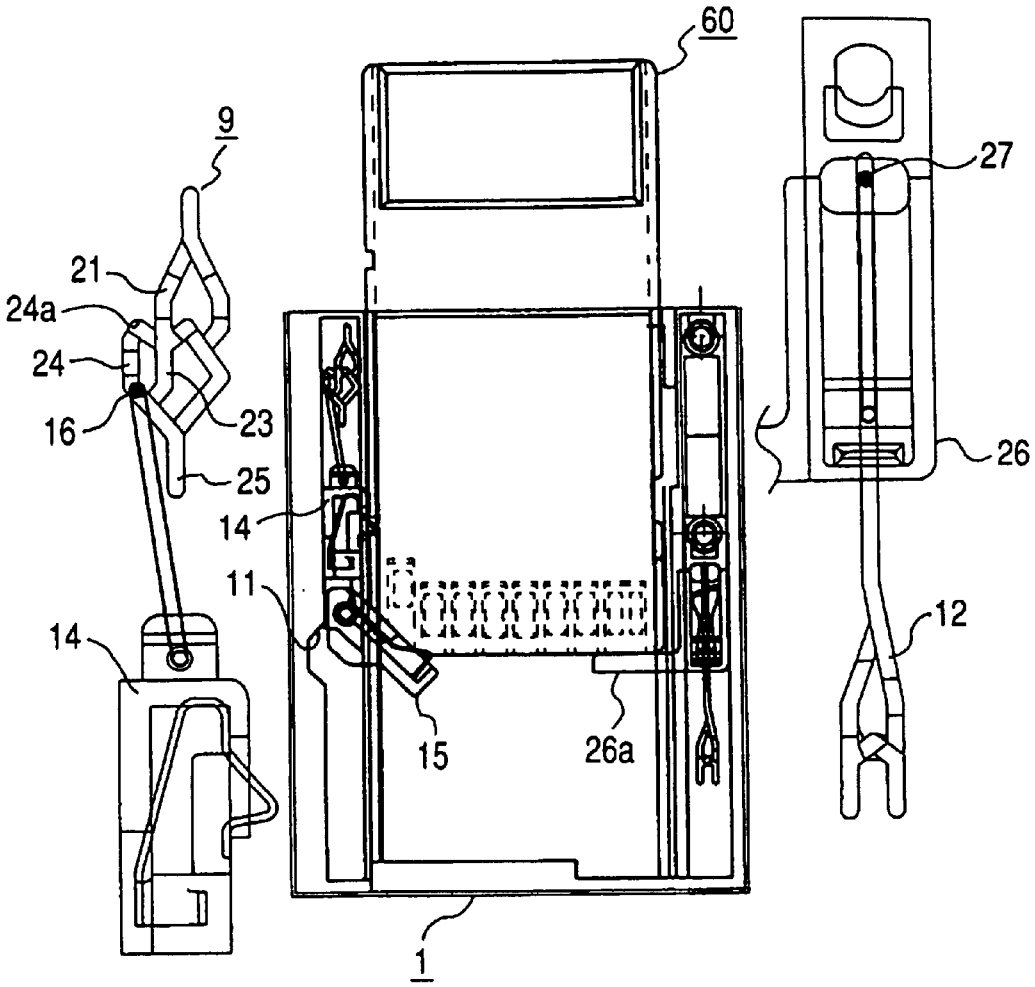
FIG. 11 illustrates the operation of the connector unit in which the longer SD card is inserted.
Figure 12:
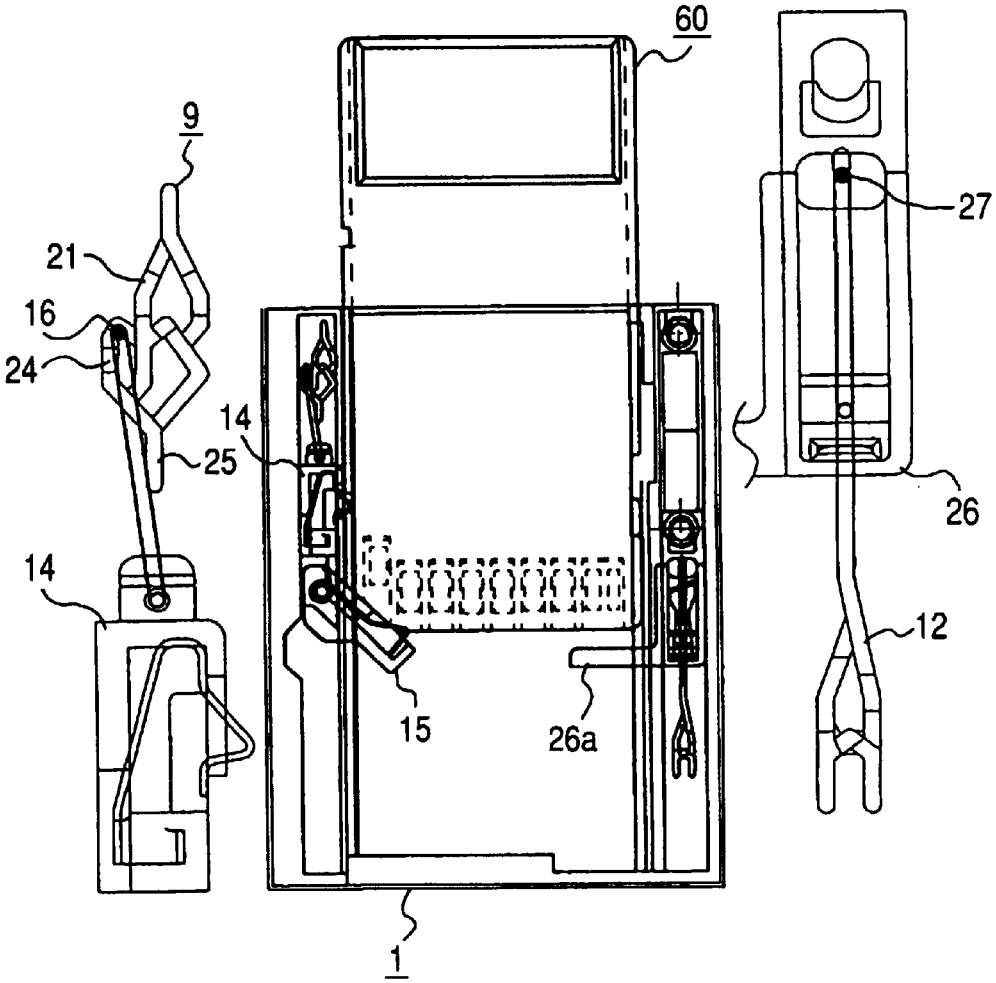
FIG. 12 illustrates the operation of the connector unit in which the longer SD card is inserted.

Or, when the SD card 60 held in the second accommodating position is to be shifted to the first accommodating position to use the antenna circuit, the SD card 60 in the state of FIG. 9 can be pressed further inward. As this causes the second engaging pin 27 to be disengaged from the pin engaging portion 12*a*, and to shift downstream in the heart-shaped cam groove 12 as indicated by arrows in FIG. 10, the SD card 60 is pressed back to the first accommodating position in the sequence shown in FIGS. 11 and 12 by the engaging portion 26*a* of the second sliding member 26 shifted outward by the elasticity of the second coil spring 29. FIG. 11 illustrates a state in which the engaging arm 15, until then kept aside in the cutout 11, rotates inward and the first sliding member 14 begins shifting outward, where the first engaging pin 16 is shifting from the extended path 25 to the return path 24. FIG. 12 shows a state in which the first engaging pin 16 is engaged by the return pin engaging portion 24*a* of the return path 24, and the SD card 60 has returned to the first accommodating position. Thus, the operator can shift the SD-card 60, held in the second accommodating position, to the first accommodating position by a simple one-push action to set the antenna circuit in a usable state. However, as is evident from FIG. 7 through FIG. 12, the moving path of the first engaging pin 16 differs with the shifting direction of the SD card 60, i.e. whether it is shifting from the first accommodating position to the second accommodating position or vice versa.

Figure 13A:
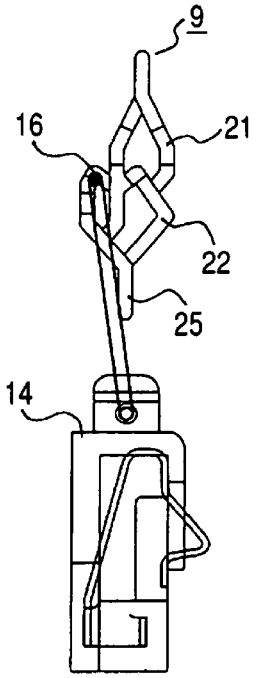
FIG. 13 illustrates the operation of the connector unit in which the longer SD card is inserted.
Figure 13B:
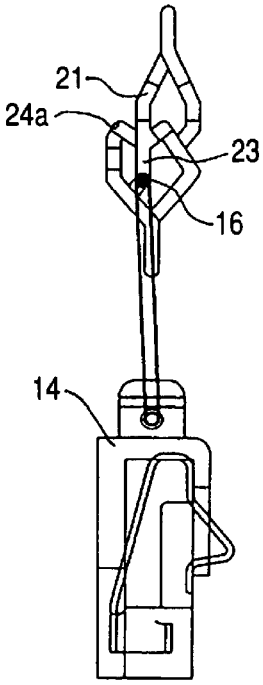
Figure 13C:
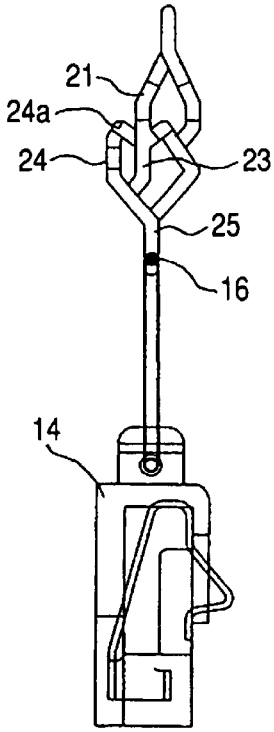
Figure 14A:
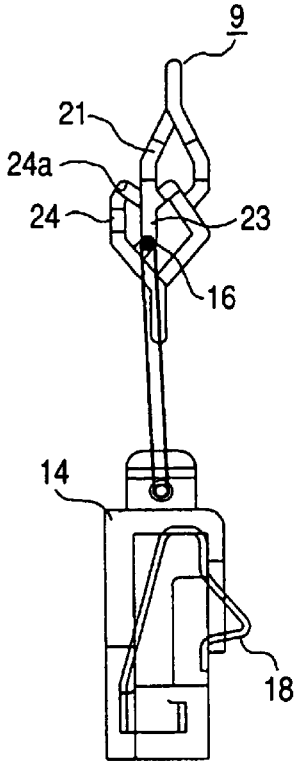
FIG. 14 illustrates the operation of the connector unit in which the longer SD card is inserted.
Figure 14B:
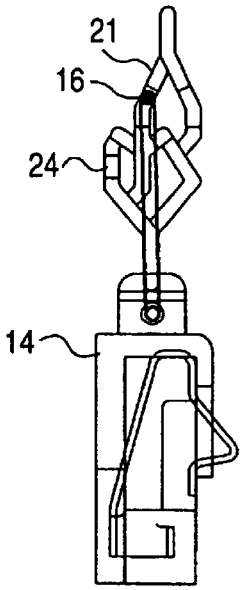
Figure 14C:
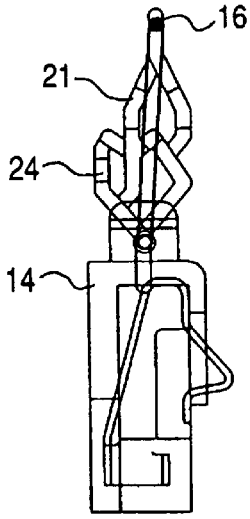
Figure 15:
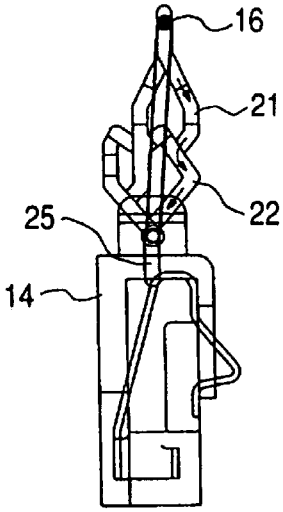
FIG. 15 illustrates the operation of the connector unit in which the longer SD card is inserted.

When the SD card 60, after it has thus been shifted from the second accommodating position to the first accommodating position to place the antenna circuit in a usable state, is to be shifted to the second accommodating position again, the operator has only to press the SD card 60 deeper inward. As this causes the first engaging pin 16 engaged with the return pin engaging portion 24*a* to shift along the second guide groove 23, which is its moving path, to the extended path 25 as shown in FIGS. 13A through C, continuing to press the SD card 60 inward will result in the state of FIG. 9 via the state of FIG. 8. When the SD card 60 having shifted from the second accommodating position to the first accommodating position to place the antenna circuit in a usable state is to be discharged, the operator can press the SD card 60 slightly inward and then remove the force acting on it. As this results in the pressing back, by the elasticity of the first coil spring 20, of the first sliding member 14 and the engaging arm 15 at the point of time when the first engaging pin 16 which has been engaged with the return pin engaging portion 24*a* has shifted midway along the second guide groove 23 as shown in FIGS. 14A through 14C, the first engaging pin 16 proceeds downstream in the heart-shaped cam groove 21 to discharge the SD card 60.

When it is desired to house the inserted SD card 60 immediately, the SD card 60 can as well be placed directly in the second accommodating position without once placing it in the first accommodating position. Thus, as the inserted SD card 60 is pressed deep inward, the first engaging pin 16 shifts from the heart-shaped cam groove 21 to the extended path 25 via the first guide groove 22 as indicated by arrows in FIG. 15, continuing to press the SD card 60 inward will result in shifting to the state of FIG. 8 via that of FIG. 9.

Figure 16:
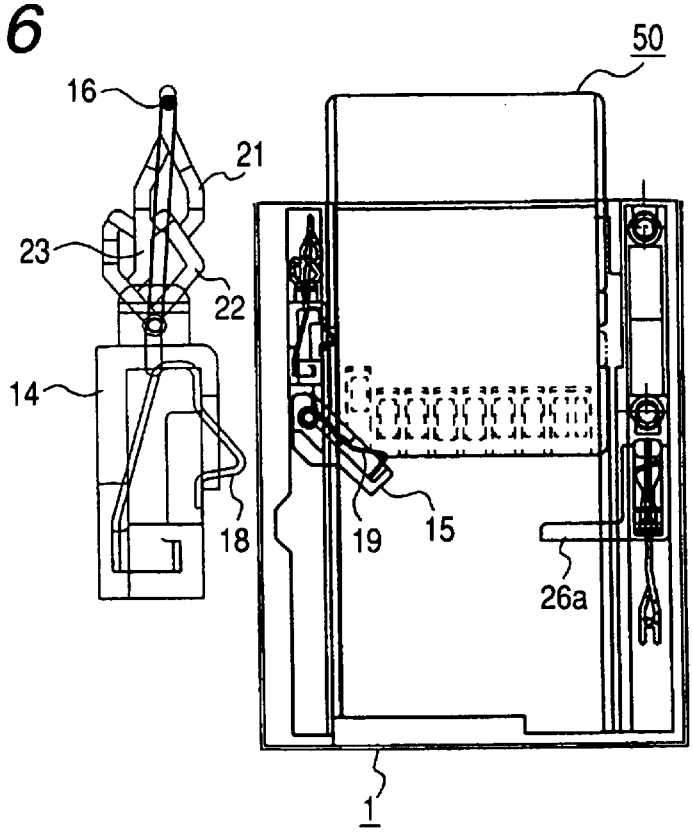
FIG. 16 illustrates the operation of the connector unit in which a shorter SD card is inserted.

Next, actions to use the shorter SD card 50 with this card connector unit will be described with reference to FIGS. 16 and 17. FIG. 16 shows a plan of the unit immediately after the start of insertion of the shorter SD card 50, and FIG. 17, a plan of the unit in which the SD card 50 is placed in the first accommodating position.

As is evident from these drawings, the shorter SD card 50 cannot be inserted so far inside as to the second accommodating position, but can only be placed in the first accommodating position. Further, as described above, the shorter SD card 50 and the longer SD card 60 are equal in the width, the arrangement of the group of external connection terminals and other respects. Therefore, exactly the same actions as described with reference to FIGS. 6 and 7 can be applied, i.e. the insertion of the longer SD card 60 into the first accommodating position and the discharging of the longer SD card 60 from that first accommodating position. For instance, if the operator presses in the shorter SD card 50 in the state shown in FIG. 16, the first engaging pin 16 will shift to the first guide groove 22 through the heart-shaped cam groove 21 and, when the pressing force is removed, the SD card 50 can be placed in the first accommodating position because the engaging pin 16 then returns to the heart-shaped cam groove 21 to be engaged with the pin engaging portion 21*a*. Or if the operator presses in the SD card 50 slightly in the state of FIG. 17, as the first engaging pin 16 engaged with the pin engaging portion 21*a* will shift to the second guide groove 23, the engaging pin 16 will proceed downstream in the heart-shaped cam groove 21 to discharge the SD card 50 when the pressing force is removed.

Figure 17:
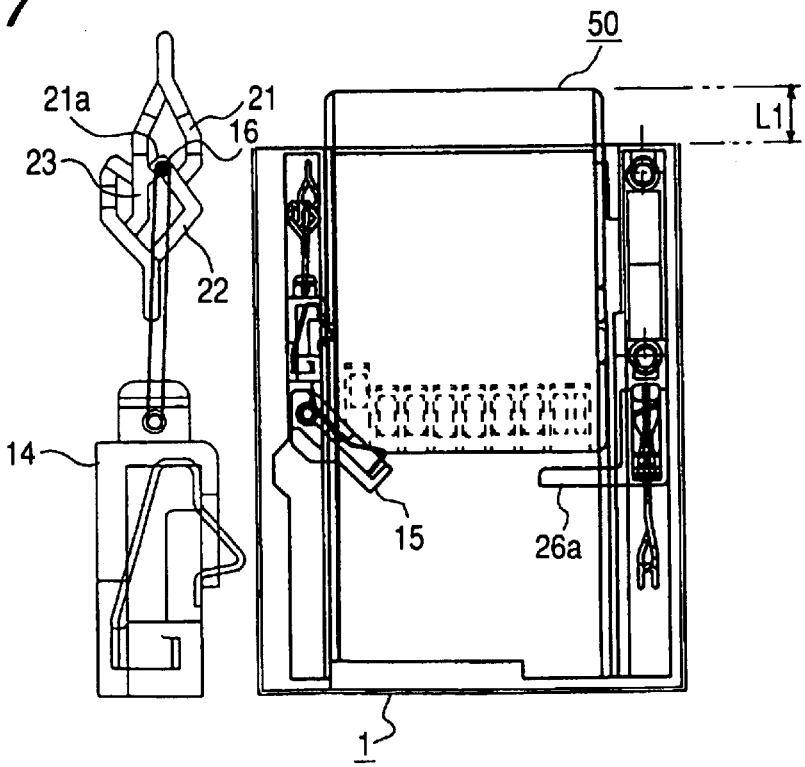
FIG. 17 illustrates the operation of the connector unit in which the shorter SD card is inserted.

To add, in this mode of implementing the invention, as shown in FIG. 17 and FIG. 9, these first and second accommodating positions are so set as to make substantially equal the outward projecting length L1 of the rear edge of the shorter the SD card 50 placed in the first accommodating position and the outward projecting length L2 of the rear edge of the longer SD card 60 placed in the second accommodating position.

Thus in this mode of implementation, not only can the shorter SD card 50 be used in the first accommodating position but also can the longer SD card 60 be used in the second accommodating position. As even the longer SD card 60 can be stowed if it is placed in the second accommodating position, there is no fear of adversely affecting the appearance or the portability of the unit.

Also, as this mode of implementation allows the longer SD card 60 to easily and smoothly reciprocate between the first accommodating position and the second accommodating position by providing the first discharging mechanism 6, having the prescribed guide groove 9, that can discharge the SD card placed in the first accommodating position and the second discharging mechanism 7 that can shift the SD card placed in the second accommodating position toward the first accommodating position, it readily provides a practical way of use in which, for instance, the SD card 60 is placed in the first accommodating position only when the antenna circuit is to be used and is stowed in the second accommodating position at other times. Moreover, as there are provided the first coil spring 20 to give a discharging force to the SD card placed in the first accommodating position and the second coil spring 29 to give a discharging force to the SD card placed in the second accommodating position, it is possible to press in the SD card with a stable force all the time and thereby to extend the service lives of the coil springs.

Figure 18:
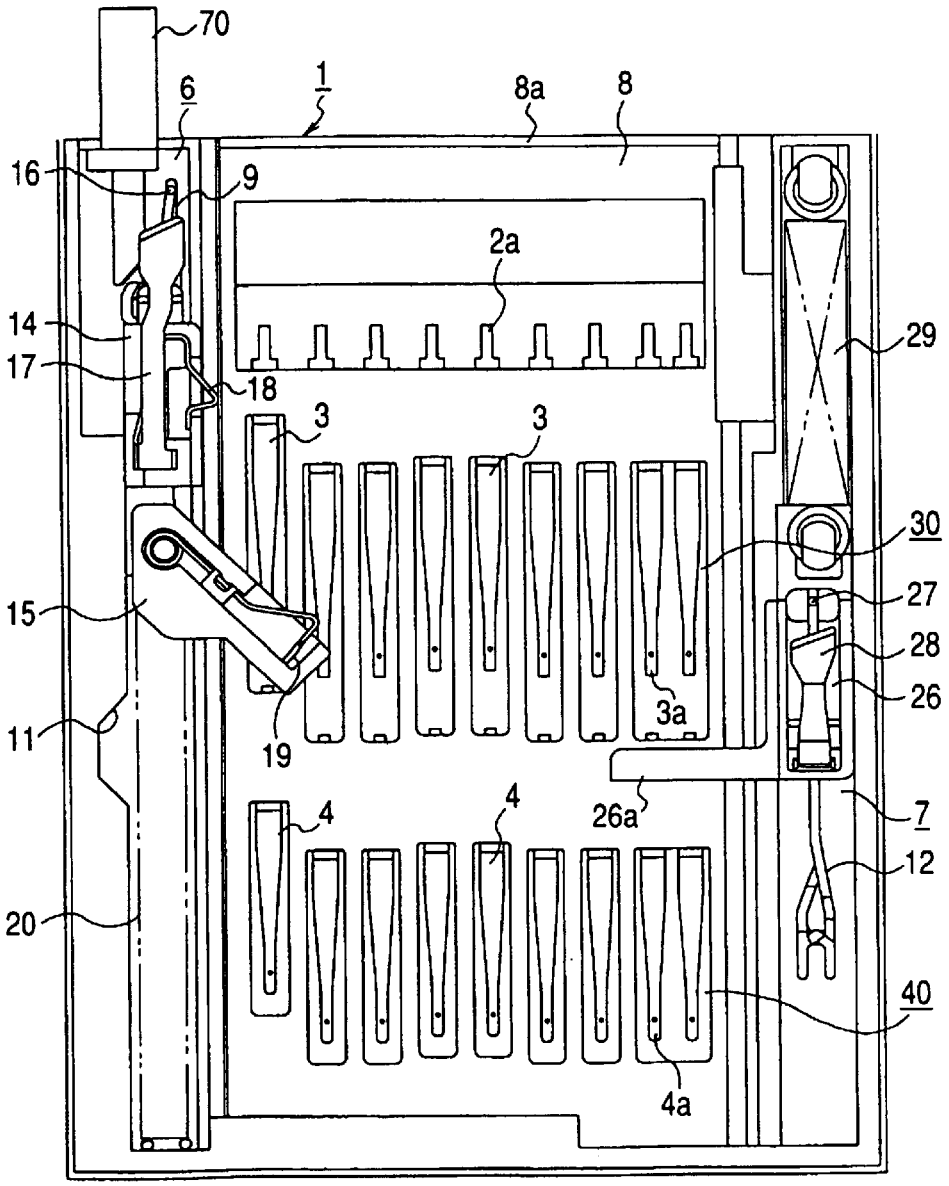
FIG. 18 shows a plan of a card connector unit in another mode of carrying out the present invention.

Another mode of implementing the present invention will now be described with reference to FIG. 18 through FIG. 20. The embodiment of the invention in this mode is designed to require the operator to press an operating member 70 for discharging use only when the longer SD card 60 having been shifted from the second accommodating position to the first accommodating position is to be discharged, and differs from the embodiment in the earlier described mode in the shape of the guide groove 9 for guiding the first engaging pin 16.

Thus, the guide groove 9 in this mode of implementation is provided with the heart-shaped cam groove 21 having the pin engaging portion 21*a* for engaging the first engaging pin 16 to hold the SD card in the first accommodating position, the guide groove 23 continuous to and from the heart-shaped cam groove 21 on the downstream side of the pin engaging portion 21*a* and extending inward, the return path 24 for guiding the direction of the first engaging pin 16 in the shifting process of the SD card from the second accommodating position to the first accommodating position, and the extended path 25 continuous to and from the guide groove 23 and the return path 24 and extending inward. Within the return path 24, there is formed the return pin engaging portion 24*a* for engaging the first engaging pin 16 shifting along this return path 24 to hold the SD card in the first accommodating position. However, unlike in the foregoing mode of implementation, the return path 24 and the guide groove 23 constitute no circulatory path and, in order to shift the first engaging pin 16 from the return pin engaging portion 24*a* to the guide groove 23, the operating member 70 has to be manipulated to push up the engaging pin 16 to the guide groove 23.

Figure 19:
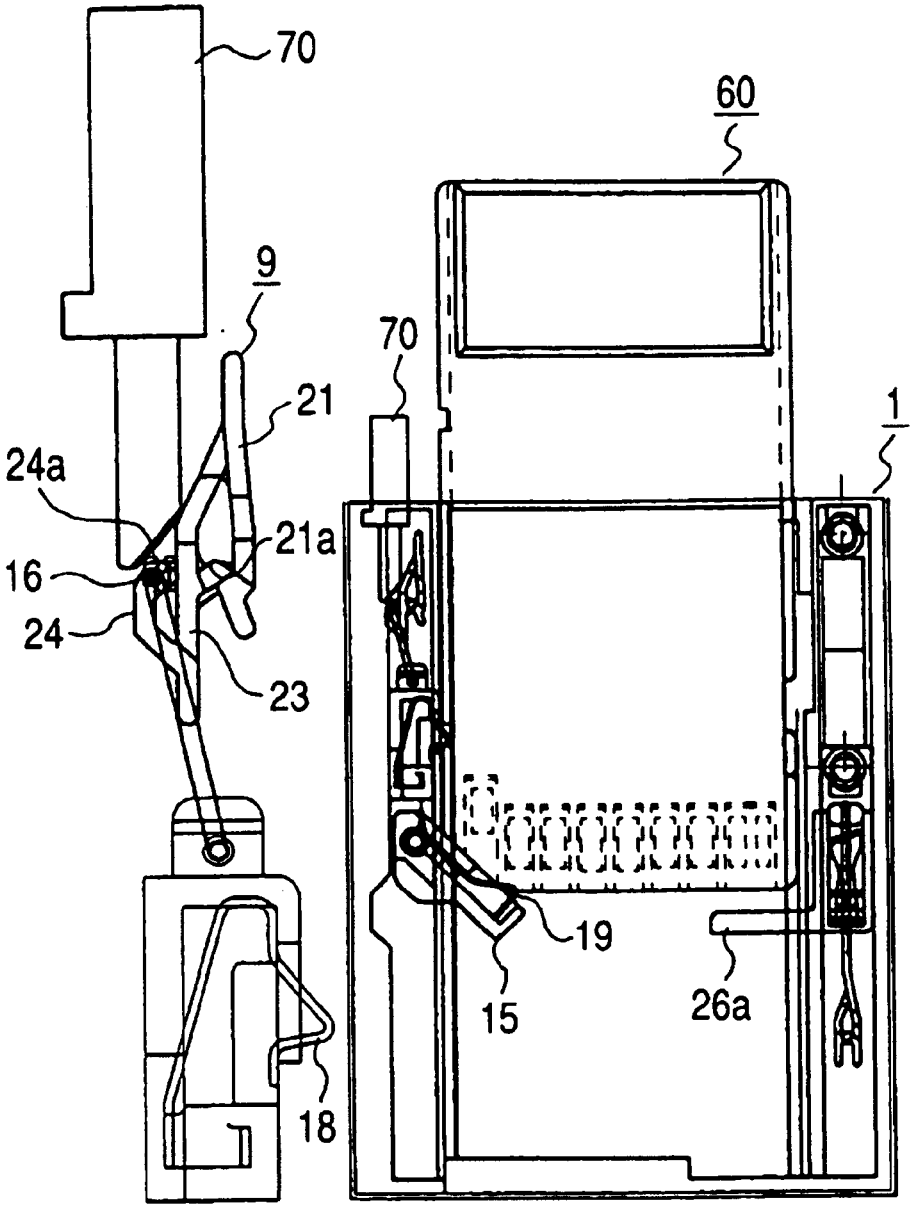
FIG. 19 illustrates the operation of the card connector unit.
Figure 20:
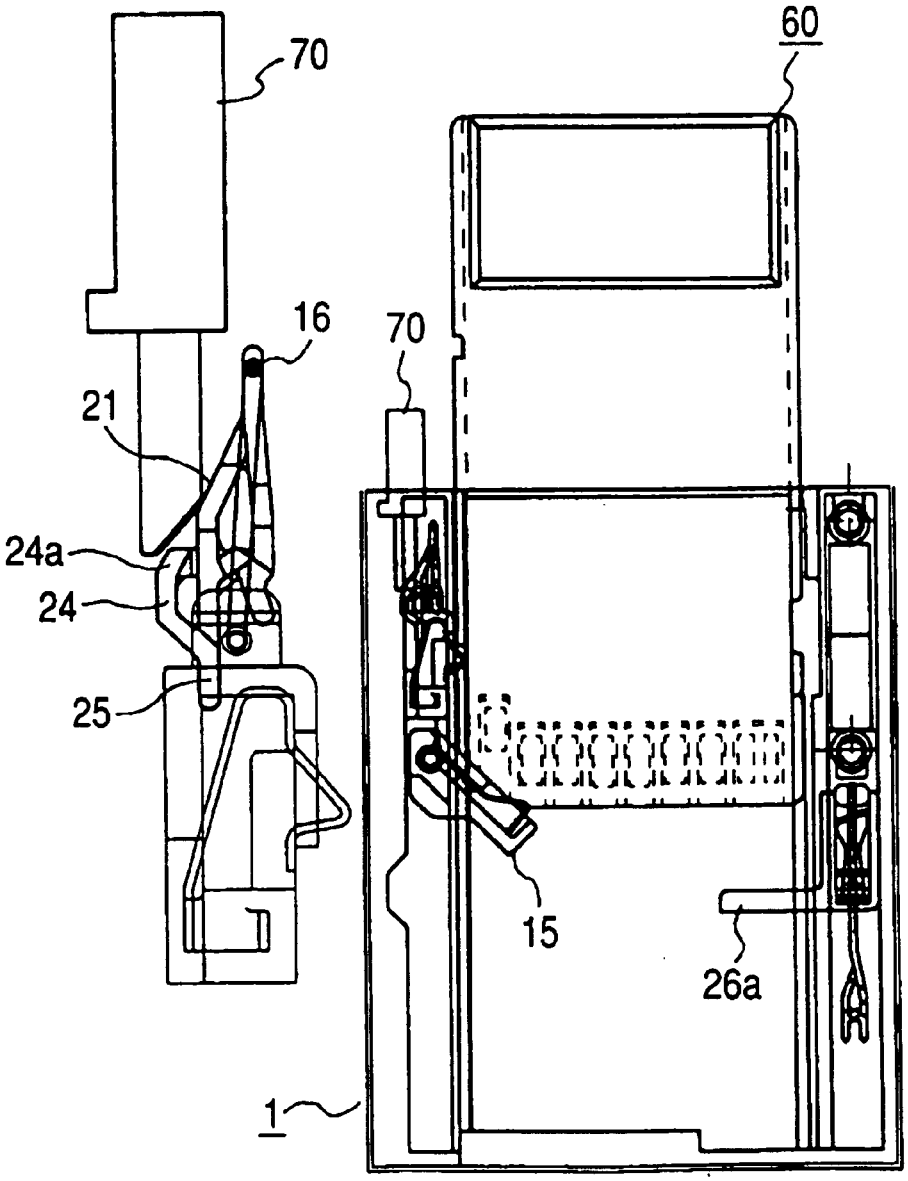
FIG. 20 illustrates the operation of the card connector unit.
Figure 21:
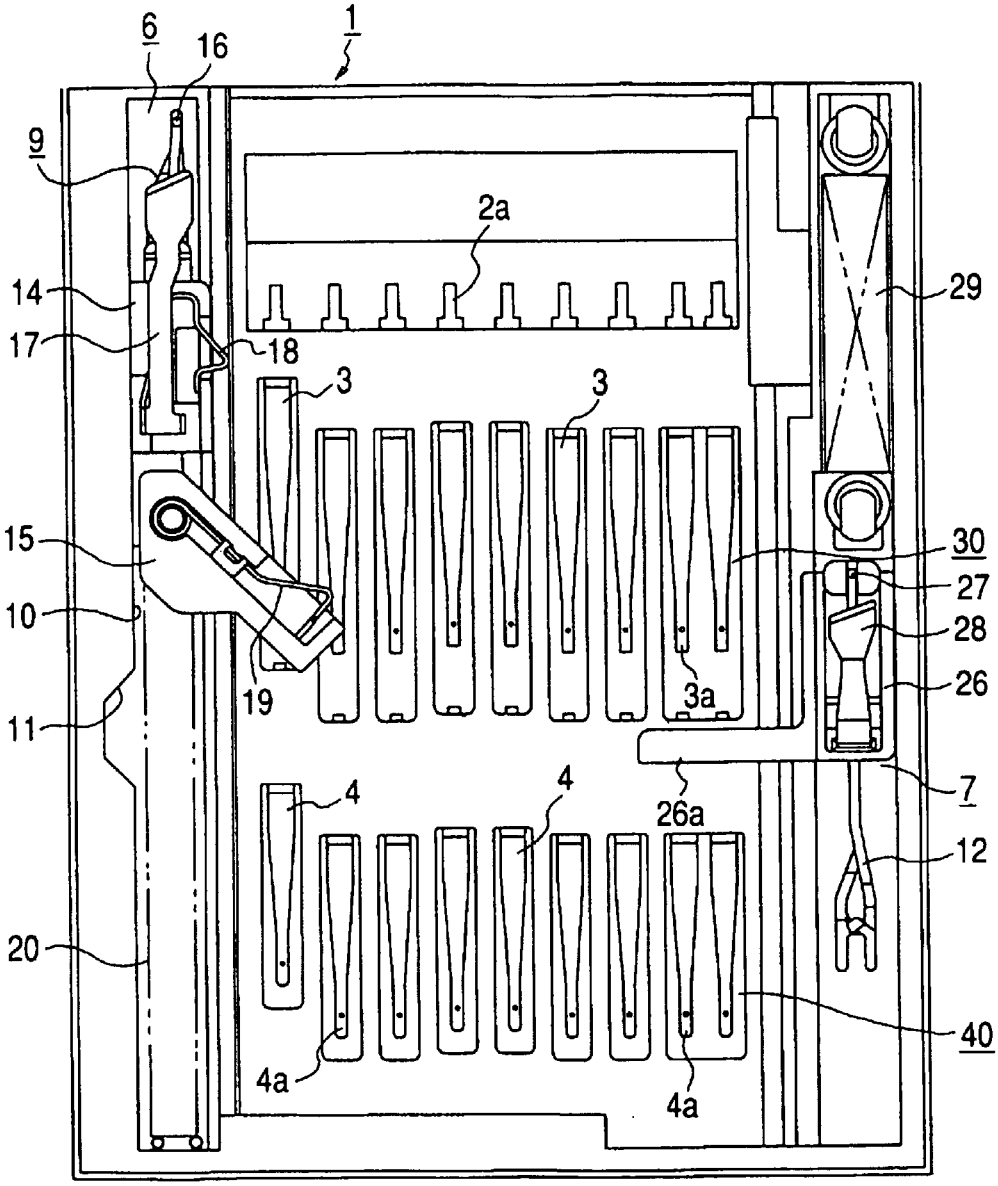
FIG. 21 shows a plan of a card connector unit in still another mode of carrying out the present invention.

FIG. 19 illustrates a state in which the longer SD card 60 having shifted from the second accommodating position is held in the first accommodating position. When the operator presses in the operating member 70 in this state, as the first engaging pin 16 engaged with the return pin engaging portion 24*a* is pushed up toward the guide groove 23, the engaging pin 16 proceeds downstream in the heart-shaped cam groove 21 to enable the SD card 60 to be discharged as illustrated in FIG. 20. However, if in the state of FIG. 19 the operator presses in the SD card 60, the first engaging pin 16 engaged with the return pin engaging portion 24*a* will proceed inward along the return path 24 only to reach the extended path 25, and therefore the SD card 60 cannot be discharged even though it can be placed in the second accommodating position. Thus in this mode of implementation, the operating member 70 is used only when the longer SD card 60 is to be discharged, and the SD card is directly pressed as in the foregoing mode of implementation when the accommodating position of the longer SD card 60 is to be altered or the shorter SD card 50 is to be inserted or discharged.

Still another mode of implement the present invention will now be described with reference to FIG. 21 through FIG. 25. The embodiment of the invention in the mode illustrated in these drawings is designed to enable the longer SD card 60 placed in the second accommodating position to be easily discharged, and differs from the foregoing modes of implementation in the shape of the guide groove 9 for guiding the first engaging pin 16.

Thus, although the guide groove 9 in this mode of implementation is provided with the heart-shaped cam groove 21 having the pin engaging portion 21*a* for engaging the first engaging pin 16 to hold the SD card in the first accommodating position, a first guide groove 22 continuous to and from the heart-shaped cam groove 21 on the upstream side of the pin engaging portion 21*a* and extending inward, a second guide groove 23 continuous to and from the heart-shaped cam groove 21 on the downstream side of the pin engaging portion 21*a* and extending inward, and the extended path 25 continuous to and from the first and second guide grooves 22 and 23 and extending inward, the return path for guiding the direction of the first engaging pin 16 in the shifting process of the SD card from the second accommodating position to the first accommodating position is dispensed with unlike in the embodiments of the invention in the foregoing modes of implementation.

Figure 22:
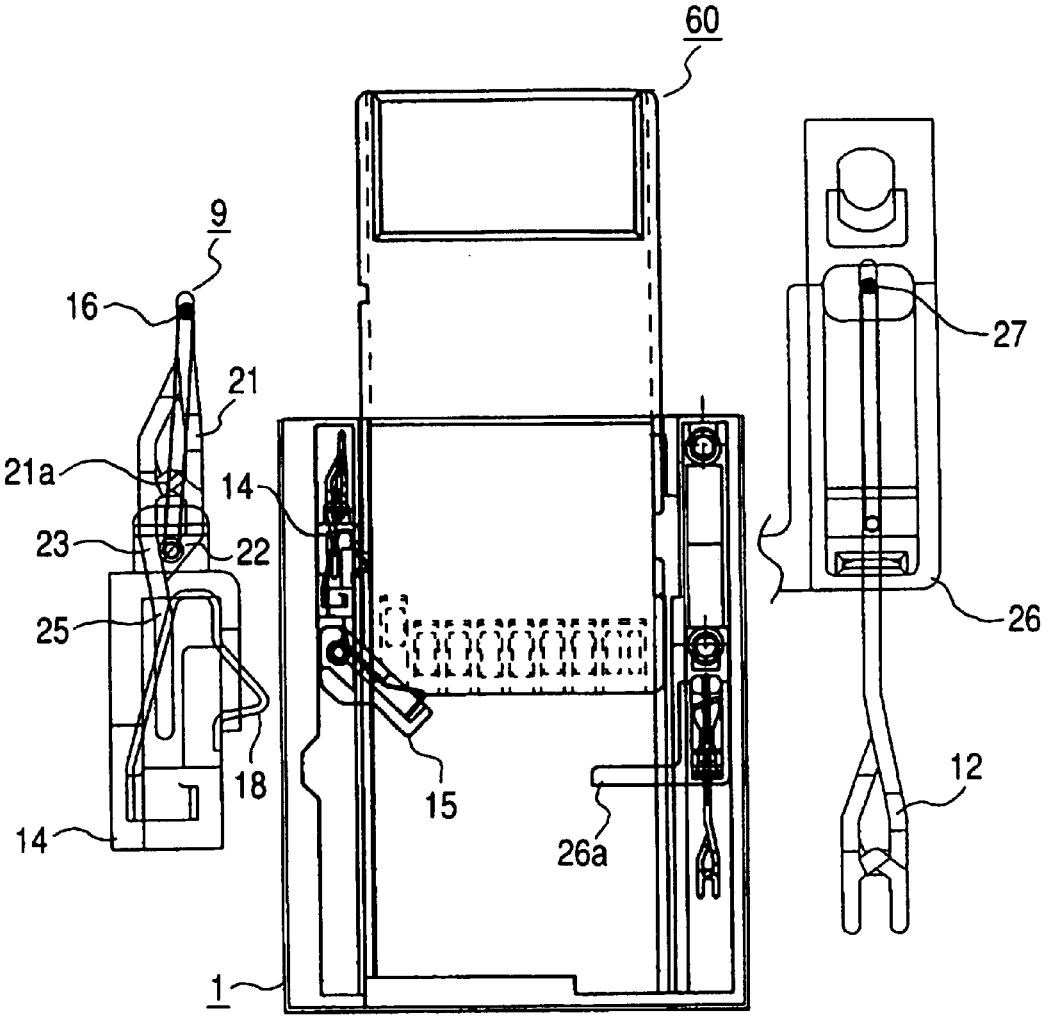
FIG. 22 illustrates the operation of the card connector unit.
Figure 23:
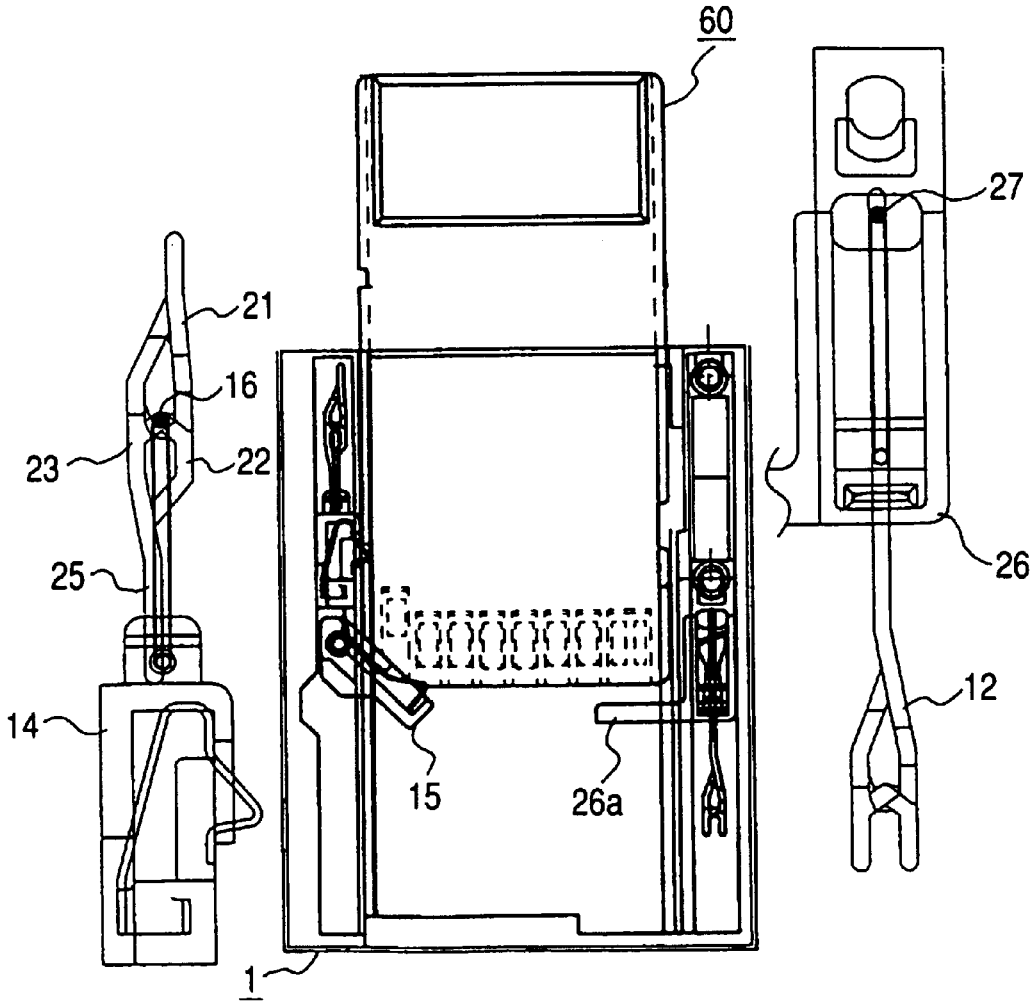
FIG. 23 illustrates the operation of the card connector unit.
Figure 24:
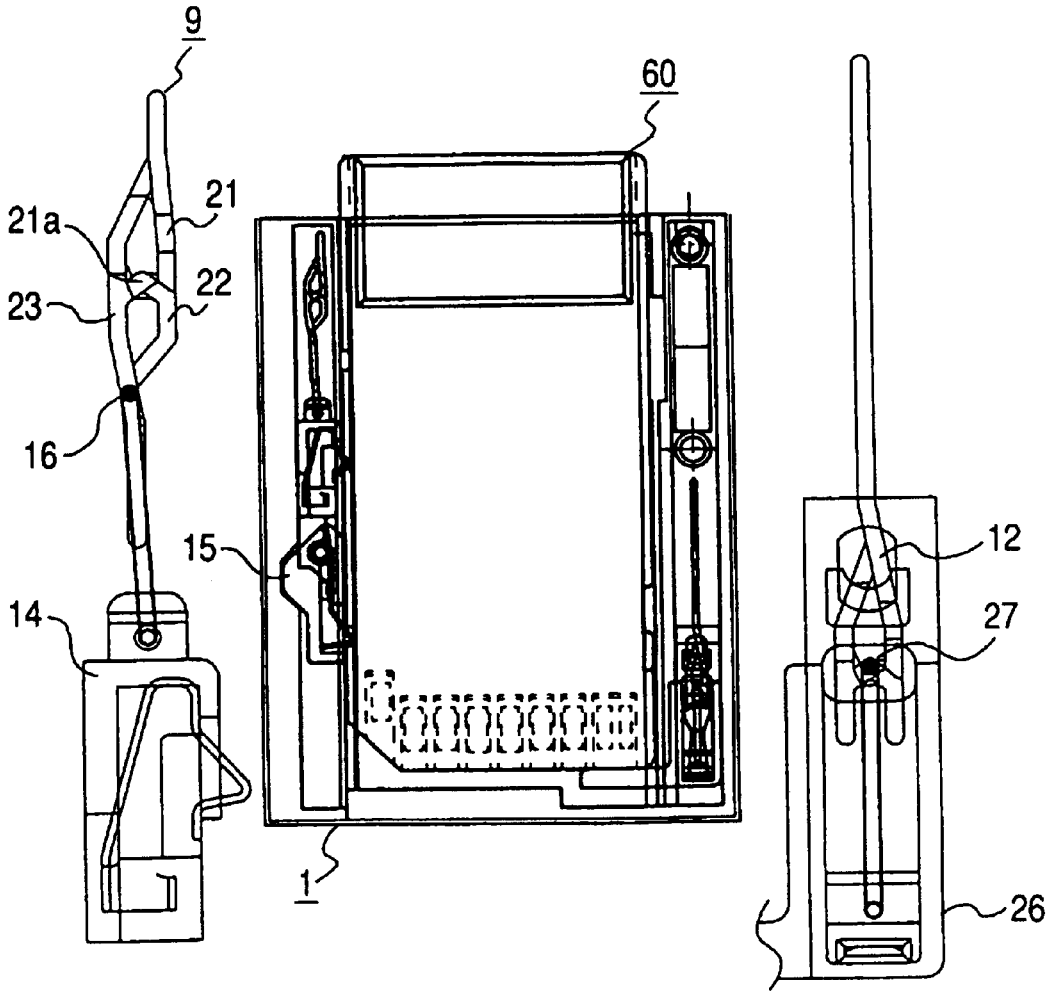
FIG. 24 illustrates the operation of the card connector unit.
Figure 25:
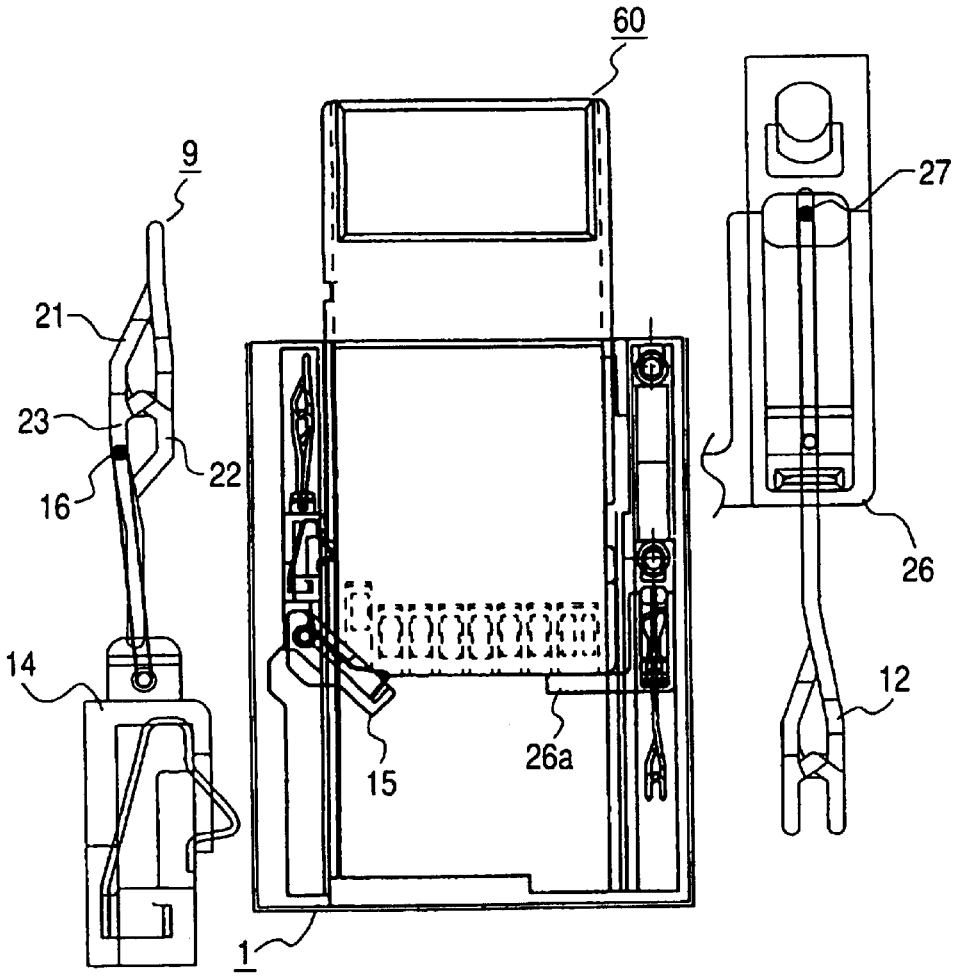
FIG. 25 illustrates the operation of the card connector unit.

Therefore, when the longer SD card 60 inserted as illustrated in FIG. 22 is to be placed in the first accommodating position as shown in FIG. 23 or to be placed in the second accommodating position as shown in FIG. 24, the same operations are done as those in the modes of implementation earlier described with reference to FIG. 6 through FIG. 9, but if the operator presses in the SD card 60 held in the second accommodating position, the first engaging pin 16 will return from the extended path 25 to the heart-shaped cam groove 21 via the second guide groove 23 as shown in FIG. 25. As a result, in this mode of implementation, the SD card can be discharged by a simple one-push action whether it is placed in the first accommodating position or in the second accommodating position.

The present invention, implemented in the modes described above, provides the following advantages.

As the card connector unit, in which a first accommodating position and a second accommodating position differing in card insertion depth are set, is provided with a first terminal section to come into contact with the external connection terminals of the SD card in the first accommodating position and a second terminal section to come into contact with the external connection terminals of the SD card in the second accommodating position, it permits not only the shorter SD card to be inserted and placed in the first accommodating position but also the longer SD card to be placed in the second accommodating position to substantially reduce the extent of its outward protrusion.

If the respectively matching terminal pieces of the first and second terminal sections and electrically connected as integrated units made of metal sheets, the task of fitting them to the electronic apparatus per se can be simplified, making it easier to reduce the cost.

Also, if the two accommodating positions are so set that the extent of the outward protrusion of the SD card is equal whether the shorter SD card is placed in the first accommodating position or the longer SD card is placed in the second accommodating position, there will be no difference in external appearance and the convenience for use will be enhanced, too.

Furthermore, if a first discharging mechanism for shifting the SD card placed in the first accommodating position in the discharging direction and a second discharging mechanism for shifting the SD card placed in the second accommodating position in the discharging direction are provided, and each discharging mechanism is equipped with a sliding member, a heart-shaped cam groove, an engaging pin, and an energizing member and the like, it will be made possible to discharge the SD card placed in either the first accommodating position or the second accommodating position merely by pressing in, resulting in easier discharging operation.

What is claimed is:

1. A card connector unit comprising a housing having an accommodating space into which a card provided with a group of external connection terminals is inserted from a side of an inlet, and a first terminal section and a second terminal section fixed to the housing and arranged in the accommodating space with positional discrepancy therebetween in a card inserting direction serving as a depthwise direction of the accommodating space, wherein a first accommodating position and a second accommodating position differing in an extent of insertion of the card into the accommodating space are set in the accommodating space, wherein the group of external connection terminals are in contact only with the first terminal section when the card is placed in the first accommodating position, and wherein the group of external connection terminals are in contact only with the second terminal section when the card is placed in the second accommodating position.

2. The card connector unit according to claim 1, wherein the first terminal section and the second terminal section have an equal number of terminal pieces arranged along a widthwise direction of the card inserted into the accommodating space, and wherein the respectively matching terminal pieces of the first and second terminal sections are electrically connected to each other.

3. The card connector unit according to claim 2, wherein respectively matching terminal pieces of the first and second terminal sections comprise mutually connected, integrated units made of metal sheets, and wherein part of the integrated units has soldering portions for soldering onto an external circuit.

4. The card connector unit according to claim 1, wherein the first and second accommodating positions are set so that, for two types of the cards differing in length in an inserting/discharging direction, an extent of an external protrusion of a shorter one of the cards out of the inlet when placed in the first accommodating position is made substantially equal to an extent of an external protrusion of a longer one of the cards out of the inlet when placed in the second accommodating position.

5. The card connector unit according to claim 1, provided with a first discharging mechanism for shifting the card placed in the first accommodating position in the discharging direction and a second discharging mechanism for shifting the card placed in the second accommodating position in the discharging direction, each of the first and second discharging mechanisms being provided with a sliding member capable of reciprocating in the depthwise direction, an engaging pin shifting along a heart-shaped cam groove along with shifting of the sliding member, and an energizing member for elastically energizing the sliding member in the discharging direction of the card; wherein, when the card is placed in the first accommodating position or the second accommodating position, the engaging pin of the matching one of the discharging mechanisms is engaged with a pin engaging portion of the heart-shaped cam groove to inhibit shifting of the sliding member, and wherein by pressing the card deeper in the accommodating space in such a state and thereby disengaging the engaging pin from the pin engaging portion, the card is shifted in the discharging direction along with shifting of the sliding member.

* * * * *